United States Patent [19]

Jones

[11] Patent Number: 4,796,598

[45] Date of Patent: Jan. 10, 1989

[54] RETRACTABLE ARROW LAUNCH RAMP WITH COMPOUND CROSSBOW

[76] Inventor: Robert L. Jones, 432 Adams St., Elyria, Ohio 44035

[21] Appl. No.: 22,981

[22] Filed: Mar. 6, 1987

[51] Int. Cl.[4] ..... F41B 5/00

[52] U.S. Cl. ..... 124/25; 124/41 A

[58] Field of Search ..... 124/25, 41 R, 41 A, 124/20 B, 22, 24 R

[56] References Cited

U.S. PATENT DOCUMENTS

| | | | |
|---|---|---|---|
| 3,224,427 | 12/1965 | Ronan | 124/25 |
| 3,581,729 | 6/1971 | Jones | 124/25 |
| 3,788,299 | 1/1974 | Mathews | 124/41 R X |
| 4,206,740 | 6/1980 | Lydon | 124/25 |
| 4,294,222 | 10/1981 | Pelsue | 124/25 |
| 4,332,232 | 6/1982 | Troncoso | 124/41 A X |
| 4,476,846 | 10/1984 | Carville | 124/41 A |
| 4,579,101 | 4/1986 | Bateman, III | 124/41 A |

*Primary Examiner*—Randolph A. Reese
*Assistant Examiner*—Anthony Knight
*Attorney, Agent, or Firm*—Gustalo Nunez

[57] ABSTRACT

A compound crossbow in which a forwardly disposed retractable arrow launch ramp is utilized to retain an arrow in position for discharge. Activation of the trigger discharges the arrow and simultaneously moves the retractable arrow launch ramp to a position which does not interfere with the forward travelling arrow. The retractable arrow rest permits the archer to move without the risk of the arrow moving into a position precluding the archer from discharging the arrow. The arrow launch ramp is removed completely from the flight path of the arrow prior to the arrow arriving at the arrow launch ramp position.

2 Claims, 5 Drawing Sheets

RETRACTABLE ARROW LAUNCH RAMP WITH COMPOUND CROSSBOW

FIELD OF THE INVENTION

The present invention relates to archery bows and more particularly to compound crossbows.

PRIOR ART

U.S. Pat. No. 3,224,427 issued Dec. 21, 1965 to Ronan, is directed to a device of the crossbow type in which have been incorporated features of a conventional sidearm and of sub-machine guns in order that the crossbow may, optionally, be operated through the use of one or both hands. The device as described is also a crossbow pistol of the collapsible type in order to facilitate its portability and the storage thereof. Ronan teaches the use of a pair of arrow rests pivotally connected by a connecting rod in which the connecting rod is fixed to a rotatable cam. The cam is controlled by the trigger mechanism such that when an arrow is discharged, the arrow rests are moved in a forward direction.

The crossbow has always been a weapon of interest and intrigue. It was developed in some form or another in most primitive cultures and with little change in its basic concept over a period of some 3000 years. The crossbow originated in China and is recorded as far back as 1500 B.C. Most ancient crossbows were released by a nut that was grooved to release the arrow when the trigger was pulled. Over the centuries this release mechanism has been changed considerably in design as more complicated systems of springs, sears, cams and pawls were developed. The arrows used with crossbows were called bolts or quarrels. The crossbows heretodate utilize a "trackless" design in which the arrow rides free rather than in a groove on the stock.

SUMMARY OF THE INVENTION

The United States is currently seeing a revived interest in crossbows and bows. As practiced in the Western world today, crossbow shooting is almost exclusively a target sport; however, the number of hunters who use crossbows to hunt wild game is steadily increasing.

The modern crossbow differs from its ancient predecessors in that the crossbow can be made lighter, have a pull of between 40 and 80 pounds and draw from 16 to 20 inches. It can be made from solid materials or laminated fiberglass, and can expell arrows at speeds approximating 200 feet per second. The arrows used with the crossbow are about one-half the length of conventional arrows and are often a little thicker than conventional arrows. The arrows may be fabricated from wood, aluminum or fiberglass and the arrow vanes may be plastic or feathers.

To string a conventional crossbow, the archer can use either of two methods. The first method is to loop one eye around one of the crossbow limbs, pulling the loop over and past a bow nock; put the other loop in the nock of the other arm; then, placing the butt of the stock on the ground between the feet, grab the bow ends, lean down on them and work the loop into the nock. The other method of stringing a crossbow uses a "bracing" string which is cord somewhat longer than the regular string. The short regular string is placed on the limbs, first in one nock and past a nock a bit on the other limb. Then the bracing string is slipped over the bows tips, drawn back to the catch (where the trigger mechanism pokes through the stock tops) and slipped over. The bow is bent enough now so that the shorter string can be easily slipped into the nocks. The arrow is then placed in the barrel groove with the cock feather down. Compound crossbows such as contemplated herein are strung by yet another method. The cord is strung about a pair of wheel pulleys such that three lengths of cord can be seen connected from each end of each limb. Two of the cords crossover each other and the third is by itself and is the one that is used to engage the arrow.

The present invention is directed to a compound crossbow which has integral thereto, a new retractable arrow launch ramp which retains the arrow prior to discharge. This arrow launcher ramp permits the archer to load the crossbow and move about with it without the arrow falling off the crossbow or moving to a position where the archer cannot accurately discharge the arrow. Thus the arrow launch ramp gives the archer mobility in the field and yet, allows the archer to be in a position whereby the arrow may be discharge to a target without a loss in accuracy. The prior art devices do not have such a retractable launch ramp. When the crossbow is in a fired or resting position, the arrow or bolt launch ramp is in a flat or parallel position in relation to the crossbow tubular stock extension. When the crossbow arrow cable is pulled rearwardly, the compound wheel cables which extend the full length of the crossbow limbs, cross each other at a point generally above center of the launch ramp and rearwardly thereto approximately one inch of said launch ramp. The launch ramp is pivotally mounted within said crossbow stock and further, is spring biased in a clockwise direction such that one end of the launch ramp, i.e. the end further from the archer, is in an elevated position. It is in this position when the arrow is mounted on the crossbow, and a portion of the arrow is placed within a hollow formed by the launch ramp. At the time the arrow is discharged, the arrow proceeds in a forward direction and the compound wheel cables also move in a forwardly direction. After the arrow has travelled a distance approximately one-half of its length, the cables pass over the launch ramp, the cables then make contact with the launch ramp forcing the ramp in a down position and thus no longer in contact with the moving arrow. This allows the arrow body and vanes to pass over the launch ramp without being deflected by the launch ramp.

DESCRIPTION OF THE PREFERRED EMBODIMENT

Figure 1:
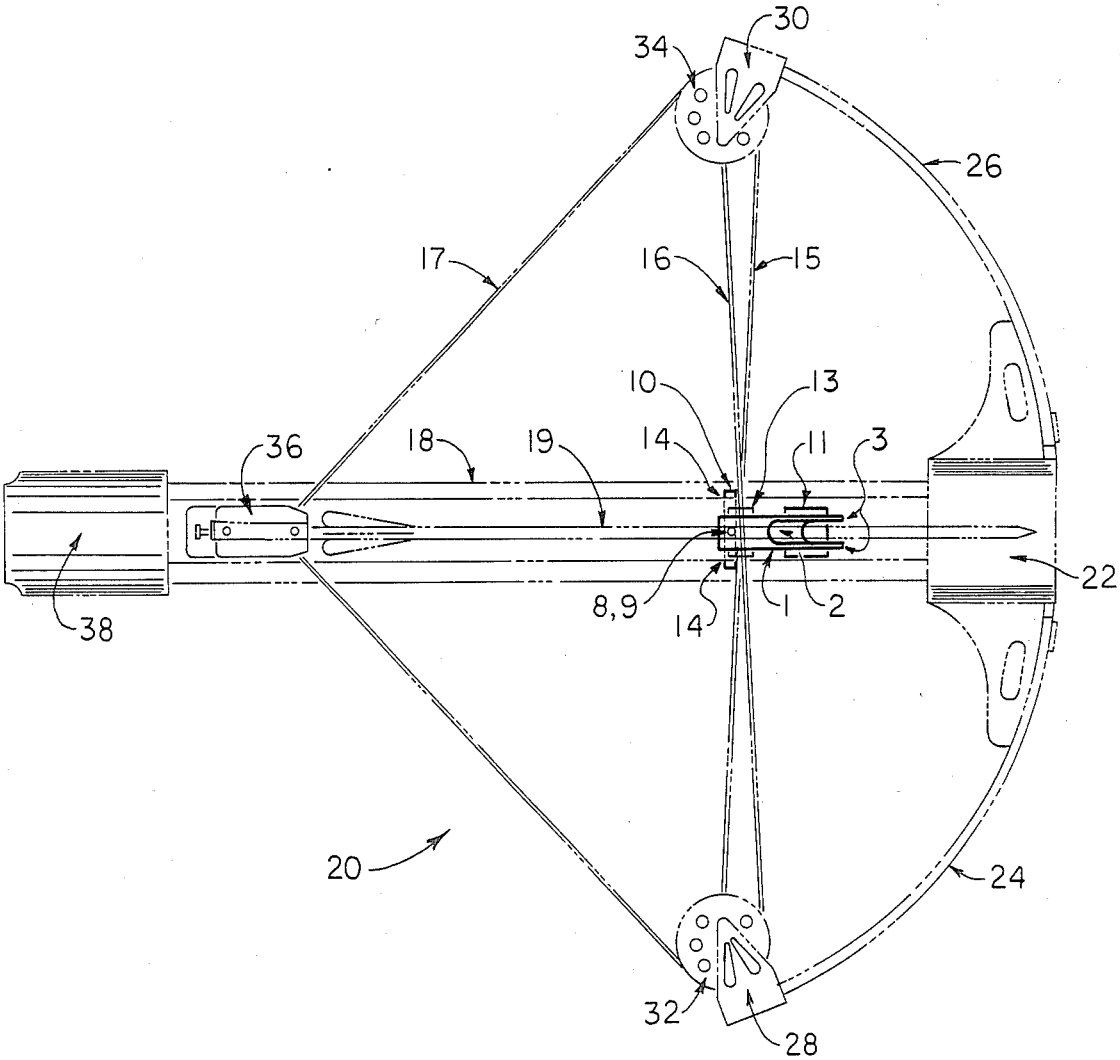
FIG. 1 is a top plane view of the compound crossbow having an arrow in a loaded position. The forward portion of the arrow is shown resting in the pivoted arrow launch ramp.
Figure 2:
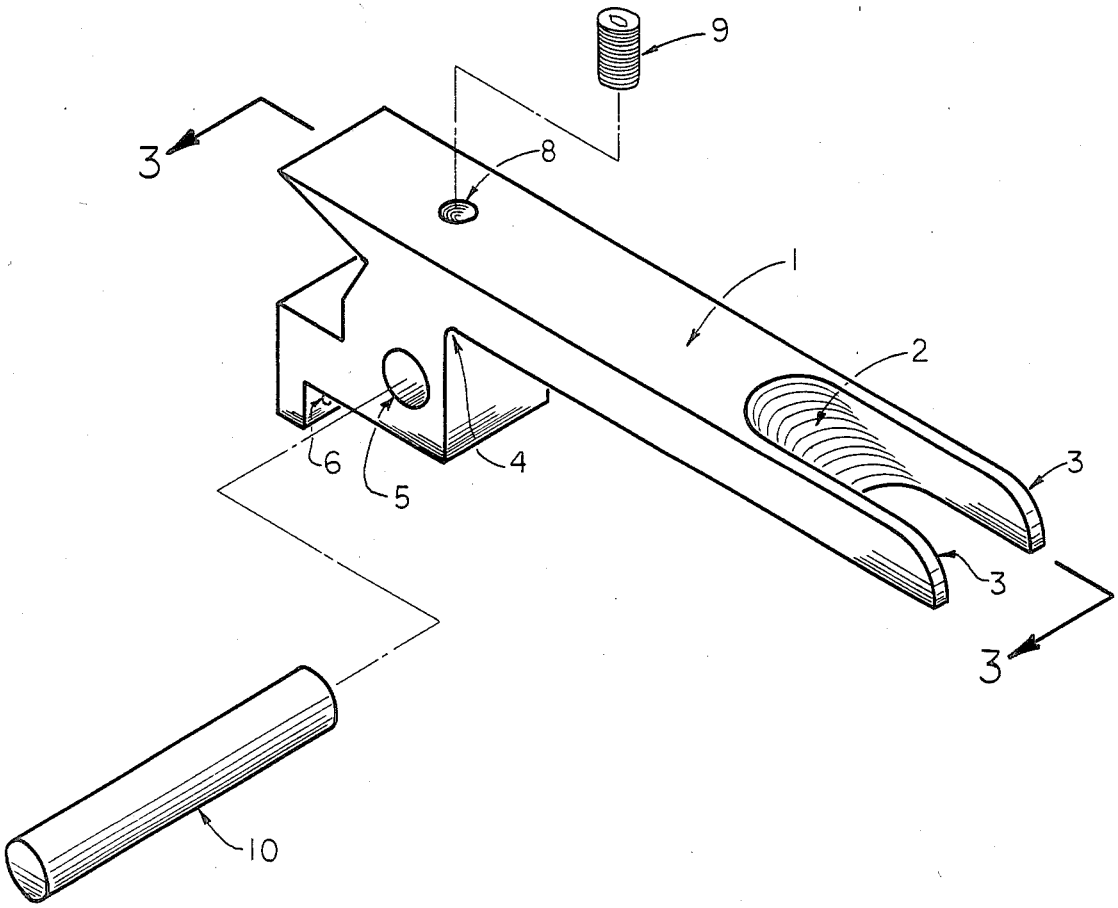
FIG. 2 is an enlarged perspective view of the arrow launch ramp.
Figure 3:
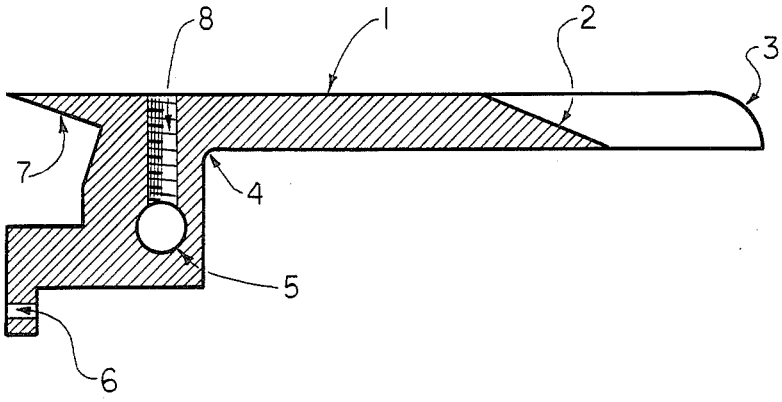
FIG. 3 is a cross-sectional view of the arrow launch ramp taken along lines 3—3 of FIG. 2.

Referring now to FIG. 1 the present device may be seen to comprise a compound crossbow assembly 50 constructed with the teachings of this invention. The crossbow 50 is provided with a stock portion 18 which is an elongated hollow member. At the forward portion of the stock member 18 there is disposed a limb adjusting bracket 22. Mounted, by conventional mounting methods, to the limb adjusting bracket 22 are a pair of bow limbs 24 and 26 which are mirror images of each other. At each extreme end of each limb 24 and 26 is positioned a pair of cable wheel bracket assemblies 28 and 30, each having rotatably cable wheels 32 and 34, each wheel adapted to receive a cable member 15 and 16. The cable wheels 32 and 34 each comprise a pair of circular pulleys concentrally mounted on each other, each pulley adapted to receive a portion of the cable. The wheels 32 and 34 are rotatably mounted onto an axle, said axle being offset from the center of the cable wheels 32 and 34. This offcenter connection causes the cable wheels to have an eccentric rotation about the axle. This type of pulley wheel configuration is quite common in modern compound crossbows, therefore, the construction details are not shown in the drawings. Although it appears that there are three cables 15, 16 and 17 across the limbs 24 and 26, the cables 15, 16 and 17 are in fact one endless cable. The stock member 18 includes a trigger and safety mechanism 36 and a rear stock member 38. Forwardly of said trigger safety mechanism 36 is an arrow launch ramp 1, see FIG. 2, having a pair of forwardly projecting parallel arrow guide rails 3 and an arrow resting seat platform 2 which forms a seat for the forward portion of an arrow. The seat 2 is formed at a skewed angle with respect to the longitudinal axis of the arrow launch ramp 1, see FIG. 3, and when seen from the top, appears to be u-shaped in configuration.

The arrow resting platform 2 is formed such that when the arrow launch ramp is in its upward position, the seat 2 is generally parallel to the stock member 18 and 38. Also provided to the launch ramp 1 is a threaded member 9 which is threadedly inserted into aperture 8 which locks the launch ramp to a launch ramp axle 10. In assembly, the axle 10 is inserted into aperture 5 which is an opening made on the launch ramp 1 and which is disposed perpendicular to the longitudinal axis of the launch ramp 1. The launch ramp 1 is provided with a tension spring retainer at 6 which for purposes of illustration, may be an aperture through which one end of a spring may be connected. At the rearward portion of the arrow launch ramp is a rearwardly extending shoulder member 7 which is known as a launch ramp stop shoulder which determines the maximum angle at which the arrow launch ramp will be elevated.

Again referring to FIG. 1, there is shown mounted on the stock member 18 a stop pad 11, which may be some resilient material such as rubber. An opening 13 is provided on the top surface of the stock member 18, through which the launch ramp is placed within the stock member 18, apertures 14 are also provided with the stock member 18 for pivotally retaining the launch ramp 1. The stock 18 contemplated herein is hollow throughout its length thereof. This allows the assembly of the launch ramp 1 to take place within the hollow chamber and also results in a lighter weapon. As mentioned previously, the launch ramp 1 is placed within the chamber formed by the stock 18 through the aperture 13 located on the top forward portion of stock member 18. A pair of oppositely opposed apertures (not shown) are disposed on the side walls of the stock member 18 for receiving the axle 10. Thus the launch ramp assembly is pivotally connected within the hollow chamber.

Figure 5:
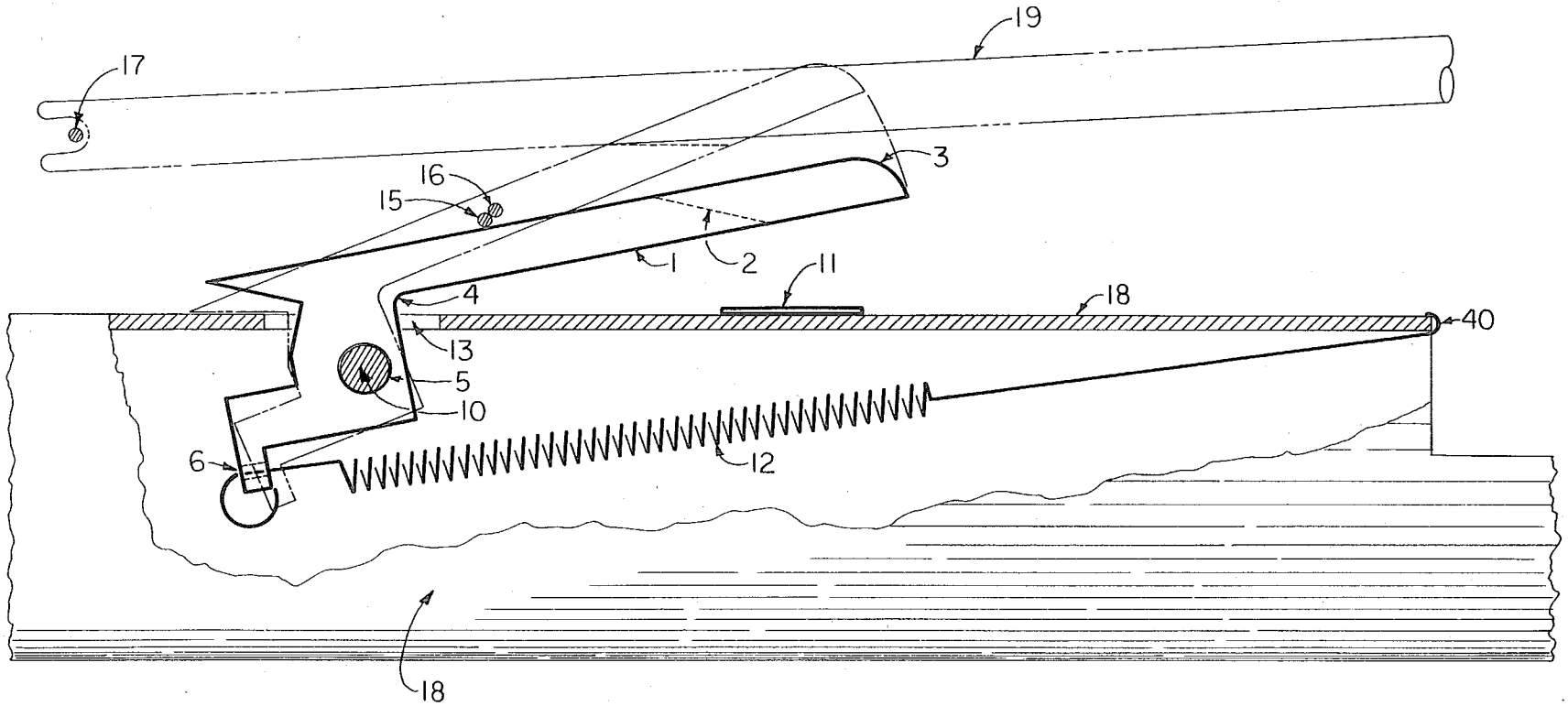
FIG. 5 is a view similar to FIG. 4, illustrating the downward position of the arrow launch ramp as the arrow travels in a forwardly direction.
Figure 6:
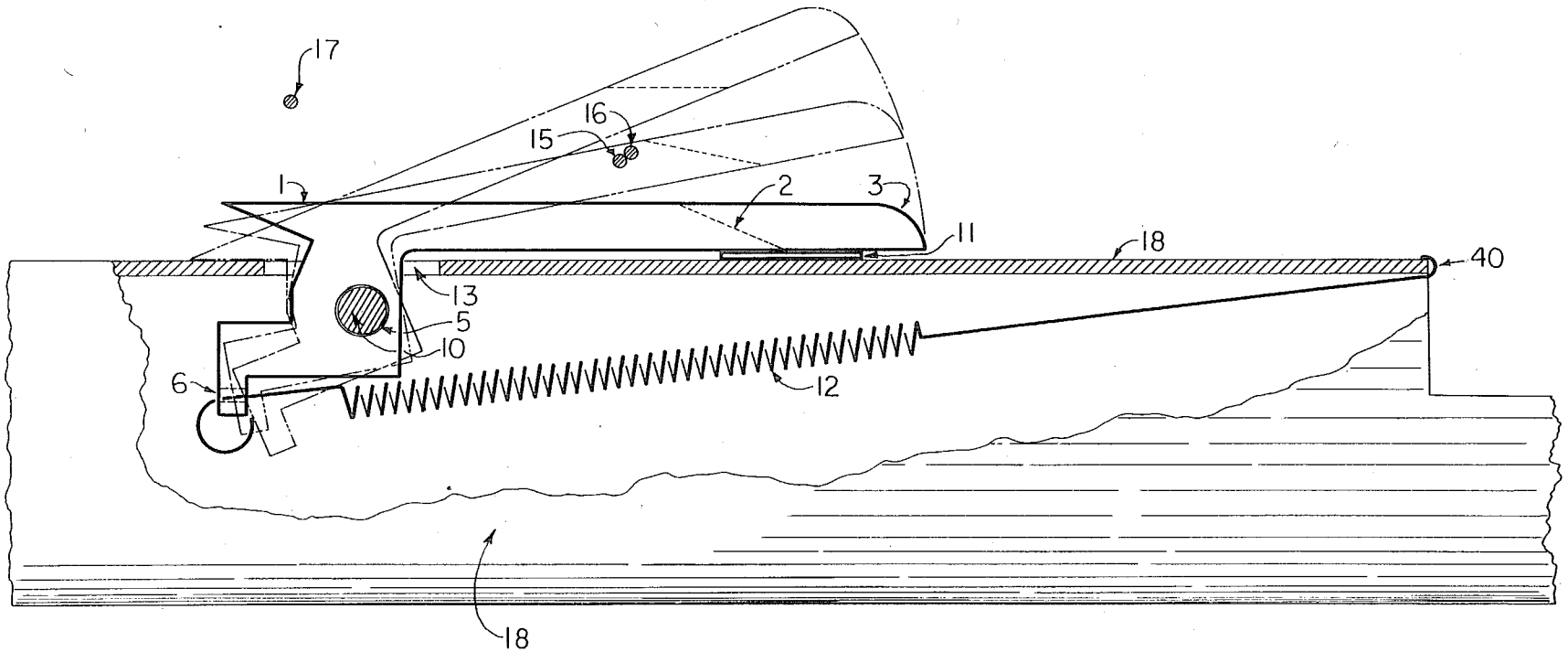
FIG. 6 is a view similar to FIG. 4 illustrating the launch ramp in a resting position.

Referring now to FIG. 5, there is shown an arrow 19 resting on the launch arrow resting seat 2. Arrow launch cable 17 is shown in the nock of the arrow 19. A spring member 12 is shown connected at one end to an aperture 6 and at the other end, connected to the stock member 18 at 40. It can be seen that the arrow launch ramp will always be biased in an upward position. FIG. 1 illustrates a conventional trigger and safety mechanism assembly, to this assembly is hooked arrow cable 17 and held in that position until the trigger releases the locking device. The nock of arrow 19 is connected to the arrow cable at the trigger and safety mechanism assembly 36.

Having described and illustrated the instant invention, the operation of the compound crossbow with a retractable arrow launch ramp will now be described.

Figure 4:
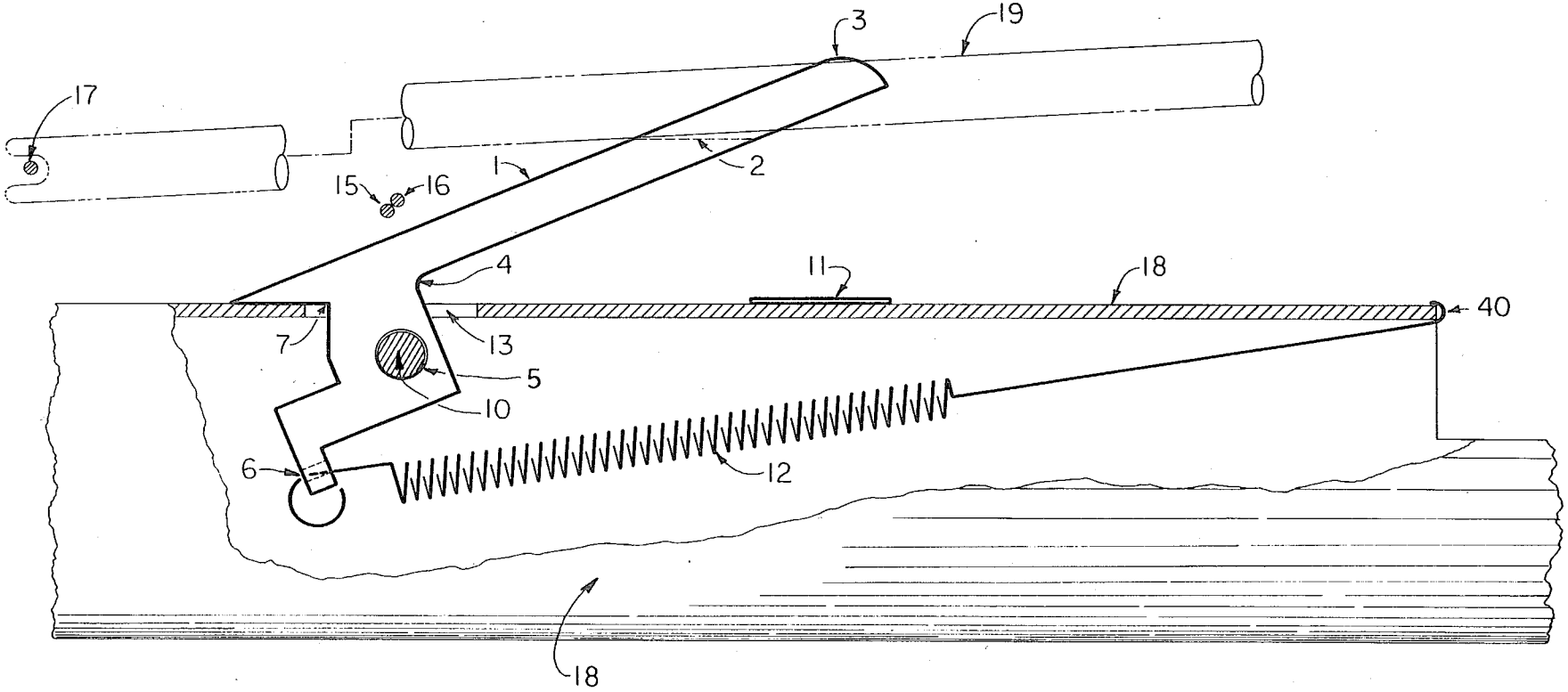
FIG. 4 is a view of the arrow launch ramp pivotally mounted within the crossbow frame.

FIG. 1 illustrates an arrow 19 positioned in the arrow launch ramp 1, ready to be discharged upon activating the trigger and safety mechanism 36. At the time that the compound crossbow arrow cable 17 is pulled in a rearward direction and locked to the trigger safety mechanism assembly, the arrow cables 15 and 16, which extend the full length of the crossbow limbs 24 and 26, cross each other at a point generally rearwardly of the center of the launch ramp 1. It has been found that the point of crossover of the crossbow compound cables 15 and 16 one-quarter of an inch rearward of the arrow launch ramp axle 10, see FIG. 4. The biasing spring member 12 holds the launch ramp member 1 in a position such that the forward portion 3 is elevated and the rearward launch ramp stop shoulder is resting on the top surface of the stock member 18. At the time that the arrow is discharged, the crossbow compound wheel cables 15 and 16 move in a forwardly direction. As the arrow 19 travels approximately one-half of its length, the compound wheel cables 15 and 16 pass over the launch ramp and begin to exert a horizontal force on the launch ramp 1 forcing the launch ramp 1 to pivotally rotate about axis 10 until the forward portion of the launch ramp 1 is adjacent the stop pad 11 and thus, out of the path of the forwardly travelling arrow 19. This is accomplished prior to the arrow vanes reaching the location of the launch ramp 1. Thus, it can be seen that the launch ramp 1 will not interfere with the forward movement of the arrow 19. The launch ramp 1, described herein, holds the arrow 19 between the pair of projecting arms 3 on the compound crossbow 50 and thus permits the archer to walk around or to set himself up prior to discharging the arrow 19 without worrying about the arrow 19 moving. Prior art devices do not permit this type of movement, thus the arrow can fall out of discharge position and thus increases the chances of making a wayward shot. Also, it has been found with the present invention, that since arrow 19 is always in its proper firing position, accuracy with this compound crossbow increases approximately 25%. The launch ramp assembly 1 may be easily mounted onto existing crossbows without any undue work and experimentation.

While the form of the arrow launch ramp herein described constitutes a preferred embodiment of the invention, it is to be understood that the invention is not limited to this precise form of apparatus, and that changes may be made therein without departing from the scope of the invention defined in the appended claims.

What is claimed:

1. A compound crossbow comprising:

an elongated hollow stock member having first and second terminating end portions, a pair of bow limbs disposed adjacent said first terminating end portion, said bow limbs each terminating at one end thereof in a cable pulley assembly, each pulley assembly comprising two wheel pulleys, an endless arrow cable strung about said pulley assemblies thereby forming a pair of crossed over cables positioned forward of a third cable, said third cable adapted to engage an arrow, an arrow launch ramp assembly disposed within the hollow stock member and located at a position defined as being past a mid-point between said first and second stock terminating ends, said arrow launch ramp being pivotally mounted onto said stock member and including a forward terminating end having a pair of generally parallel spaced arms and a seat portion describing a surface generally parallel to said stock member when said arrow launch is in an upward position, trigger and arrow holding means mounted on said second terminating end of said stock member, biasing means for normally retaining said arrow launch ramp in an arrow support position when said third cable is drawn and hooked to the arrow holding means, the forward most part of an arrow being placed upon said seat portion and the most rearward part of said arrow engaged by said third cable, and means for urging said arrow launch ramp to a position generally parallel to a plane described by said stock member upon the release of said third cable thereby removing said arrow launch ramp from the arrow flight path upon the discharge of said arrow.

2. A compound crossbow comprising:

an elongated stock member being hollow throughout its length, a pair of bow limbs disposed adjacent one terminating end thereof, means for stringing an endless cable across said bow arms such that three cable portions are strung across said bow limbs such that two cable portions cross each other and a third cable portion disposed rearwardly of said two crossed over cable portions, an arrow launch ramp assembly pivotally disposed within said hollow stock portion and having a member thereof protruding through said hollow stock member at a location immediately adjacent said crossed over cable portions, said protruding member including an extending projection terminating at one end thereof in a pair of generally parallel extending arms forming a seat platform at a closing end of said generally parallel arms, said seat platform when in an operational position adapted to receive the forward portion of an arrow, trigger and arrow cable holding means disposed at a terminating end of said elongated stock member, biasing means for retaining said arrow launch ramp in an elevated position when said third cable portion is drawn to said arrow cable holding means, the forward most part of an arrow being placed upon said seat portion and the most rearward part of said arrow engaged by said third cable, and said arrow launch ramp being urged to a position generally parallel to a plane described by said stock member upon the release of said third cable thereby removing said arrow launch ramp from the arrow flight path upon the discharge of said arrow

* * * * *